US006877240B2

(12) United States Patent
Tranas

(10) Patent No.: US 6,877,240 B2
(45) Date of Patent: Apr. 12, 2005

(54) APPARATUS FOR INDICATING CORRECT OR FAULTY BACK POSTURE

(76) Inventor: Randi Henden Tranas, Nordahl Griegs VEG 3C, N-7800 Namsos (NO)

( * ) Notice: Subject to any disclaimer, the term of this patent is extended or adjusted under 35 U.S.C. 154(b) by 0 days.

(21) Appl. No.: 10/702,767

(22) Filed: Nov. 7, 2003

(65) Prior Publication Data

US 2004/0093751 A1 May 20, 2004

Related U.S. Application Data

(63) Continuation of application No. 09/909,833, filed on Jul. 23, 2001, now abandoned, which is a continuation-in-part of application No. 09/425,465, filed on Oct. 22, 1999, now Pat. No. 6,279,243, which is a continuation of application No. 08/801,304, filed as application No. PCT/NO95/00150 on Sep. 5, 1995, now abandoned.

(51) Int. Cl.[7] ..... G01L 9/00; G01I 9/10

(52) U.S. Cl. ..... 33/512; 33/365; 33/391; 116/215

(58) Field of Search ..... 33/512, 365, 366, 33/511, 390–391, 347, 371; 116/215

(56) References Cited

U.S. PATENT DOCUMENTS

| | | | |
|---|---|---|---|
| 2,191,683 | A | 2/1940 | Roberts |
| 2,357,746 | A | 5/1944 | Kuss |
| 2,494,278 | A | 1/1950 | Badovinac |
| 2,673,544 | A | 3/1954 | Erickson |
| 3,025,064 | A | 3/1962 | Flood |
| 3,063,721 | A | 11/1962 | Jackson et al. |
| 3,098,316 | A | 7/1963 | McCarthy |
| 3,099,245 | A | 7/1963 | Desner |
| 3,156,211 | A | 11/1964 | Mallory, Jr. |
| 3,229,903 | A | 1/1966 | Smith |
| 3,429,052 | A | 2/1969 | Hembd et al. |
| 3,522,701 | A | 8/1970 | Perry |
| 3,528,664 | A | 9/1970 | Gunn, Jr. |
| 3,703,878 | A | 11/1972 | Badovinac |
| 4,196,524 | A | 4/1980 | Bechtel |
| 4,514,908 | A | 5/1985 | Yamaguchi |
| 4,829,676 | A | 5/1989 | Waldron |
| 4,972,595 | A | 11/1990 | Shimamura et al. |
| 5,005,835 | A | 4/1991 | Huffman |
| 5,157,842 | A | 10/1992 | Swanda |
| 5,168,264 | A | 12/1992 | Agustin |
| 5,380,001 | A | 1/1995 | Socci et al. |
| 5,398,422 | A | 3/1995 | Clarkson |
| 5,428,846 | A | 7/1995 | Socci et al. |
| 5,447,305 | A | 9/1995 | Socci et al. |

FOREIGN PATENT DOCUMENTS

| | | |
|---|---|---|
| NO | 171 349 | 11/1992 |
| SU | 1648514 | 5/1991 |

*Primary Examiner*—G. Bradley Bennett
*Assistant Examiner*—Yaritza Guadalupe
(74) *Attorney, Agent, or Firm*—Hunton & Williams LLP

(57) ABSTRACT

An apparatus for indicating correct or faulty back posture comprises a housing and an indicator body. The housing is supported on the user's body. When the user's back posture or head position is incorrect, the indicator body moves and signals the user of the incorrect posture or position, e.g., through an audible alarm.

11 Claims, 6 Drawing Sheets

APPARATUS FOR INDICATING CORRECT OR FAULTY BACK POSTURE

This application is a continuation of U.S. patent application Ser. No. 09/909,833, filed Jul. 23, 2001 (abandoned), which is a continuation-in-part of U.S. patent application Ser. No. 09/425,465, filed Oct. 22, 1999 (now U.S. Pat. No. 6,279,243), which is a continuation of U.S. patent application Ser. No. 08/801,304, filed Feb. 18, 1997 (abandoned), which is a § 371 application or a continuation of PCT/NO95/00150, filed Sep. 5, 1995, the entire contents of which are incorporated herein by reference in a manner consistent with the invention and text of this application.

BACKGROUND OF THE INVENTION

I. Field of the Invention

The present invention relates to a device for placing on a person's head to indicate correct or incorrect upright posture during the performance of various activities in a standing or sitting position, comprising a balance element connected to a headband, a hairband, an ear clip or other appropriate means for attachment to a person's head.

II. Description of Related Art

A device of this kind is taught in the applicant's own Norwegian Patent 171,349. This device consists of a balance body which is attached to a U-shaped band, which in turn is attached to a hairband or similar. A spring or similar is located between the legs of the U-band so that the balance body will tip forward when the head is moved too far forward and out of a correct head position. When this happens, a signal will be given to indicate that the user has assumed an incorrect sitting posture.

This device functions extremely well under qualified guidance, but nevertheless is encumbered with certain weaknesses. For example, the device is rather large and lumpy and projects quite high above the user's head. This means that the device could easily be torn off the head if the user knocks into a low door frame or other obstruction.

Further, the device has proven to be somewhat difficult to calibrate and is very sensitive to deviations from the correct calibration. Moreover, it is difficult for the user to perceive when the balance body of the device tips forward, and he or she is therefore dependent on either a mirror or having another person present as an observer.

Moreover, the device will only indicate incorrect head position when the head is tipped too far forward. It will not indicate an incorrect head position when the head is tipped sideways.

SUMMARY OF THE INVENTION

In order to eliminate these disadvantages it is therefore proposed to design the device as described in the characterizing clause of independent claim 1 below, and also in the subsequent dependent claims.

BRIEF DESCRIPTION OF THE DRAWINGS

The device will be described in more detail below with reference to the accompanying drawings, wherein:

FIG. 6 shows the device from above and with the moveable body in a neutral position;

FIG. 7 shows a section along the line VII—VII in FIG. 6;

FIG. 8 shows the device from above with the moveable body displaced from the neutral position;

FIG. 9 shows a section along the line IX—IX in FIG. 8.

DETAILED DESCRIPTION OF THE PREFERRED EMBODIMENTS

Figure 1:
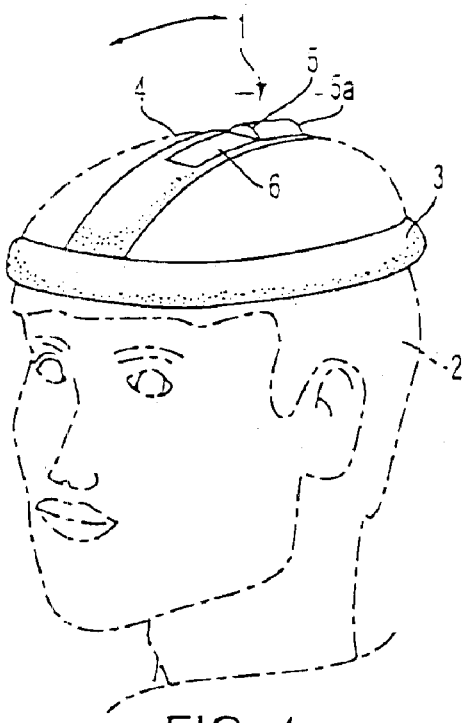
FIG. 1 illustrates a device where the moveable body is a slide which can move in a channel in the fixed body.

In FIG. 1, a device 1 is shown placed on a person's head 2 with the aid of an attachment means 3, which may be a hairband, a headband or another appropriate means. The device 1 consists of a fixed body 4, which is firmly secured to the attachment means 3, and a moveable body 5, which can move translationally relative to the fixed body 4.

In the exemplary embodiment according to FIG. 1, the moveable body 5 consists of a slide block 5*a* which is designed to move in a channel 6 in the fixed body 4. When the position of the head is correct, the block 5*a* will preferably be at the highest point of the head and preferably in the rear end of the channel 6. If the head is bent too far forward, the weight of the block 5*a* will overcome the frictional forces against the channel 6 and the block 5*a* will move forward in the channel 6. The materials and design of the block 5*a* and the fixed body can be chosen so that an audible sound is made when the block 5*a* strikes the end of the channel 6.

Figure 2:
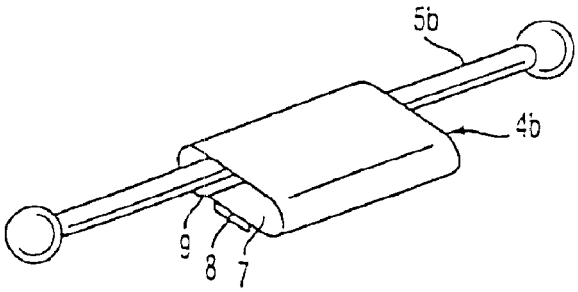
FIG. 2 shows a device where the moveable body is a pin which, when the head position is incorrect, will move out of a recess in the fixed body.
Figure 3A:
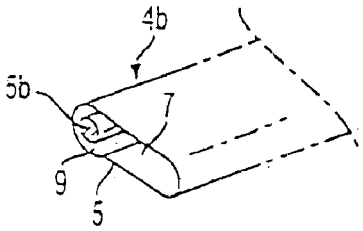
FIGS. 3*a* and 3*b* show the movement of the moveable body according to FIG. 2.
Figure 3B:
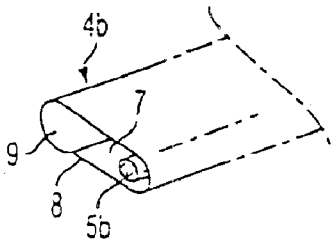

In FIG. 2, a second embodiment of the device is shown. Here, the moveable body 5 consists of a pin 5*b* and the fixed body consists of a holder 4*b* equipped with a through-going slot 7 which defines a plane 8 having a recess 9 at the rear end thereof. When the position of the head is correct, the pin 5*b* is in the recess 9, but when the head is tipped too far forward, it will roll out of the recess 9 and down the plane 8 and preferably make an audible sound when it strikes against the end of the holder 4*b*. FIGS. 3*a* and 3*b* show the position of the pin 5*b* when the position of the head is correct and incorrect, respectively.

Figure 4:
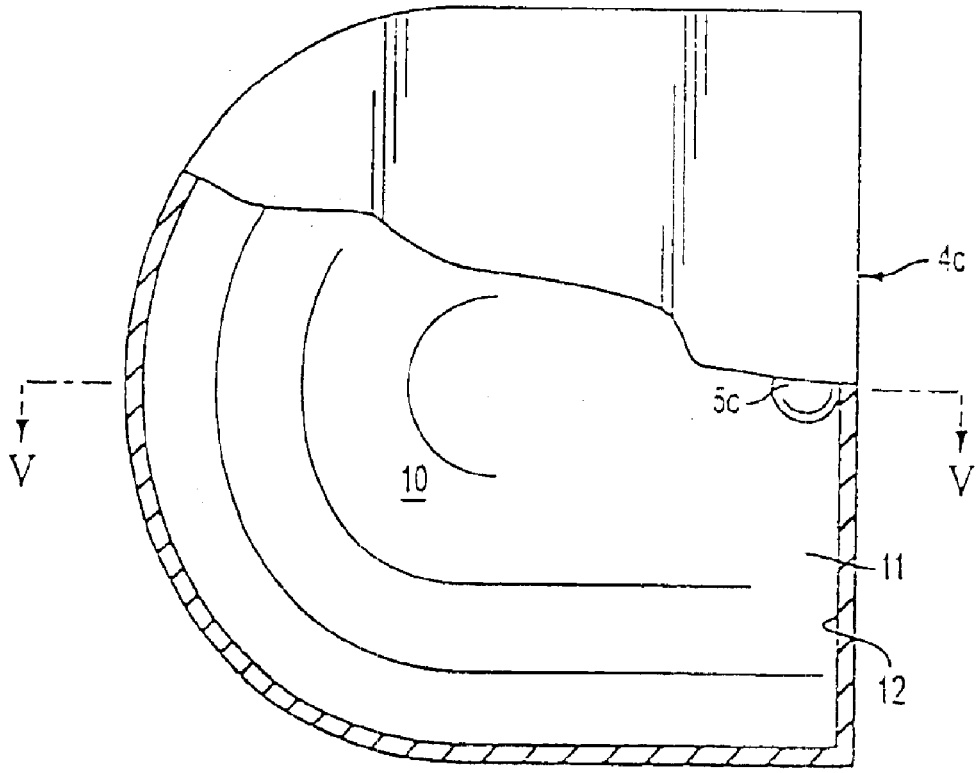
FIG. 4 illustrates a device where the moveable body is a ball which will roll along an inclined plane when the head position is incorrect.
Figure 5:
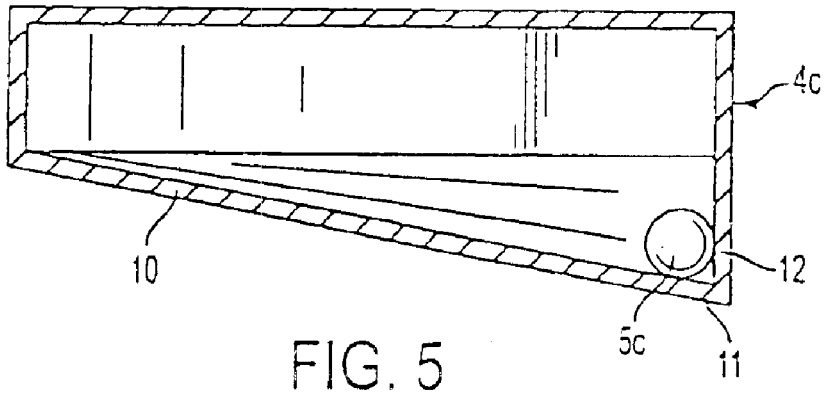
FIG. 5 shows a section through the device in FIG. 4 along the line V—V.
Figure 8:
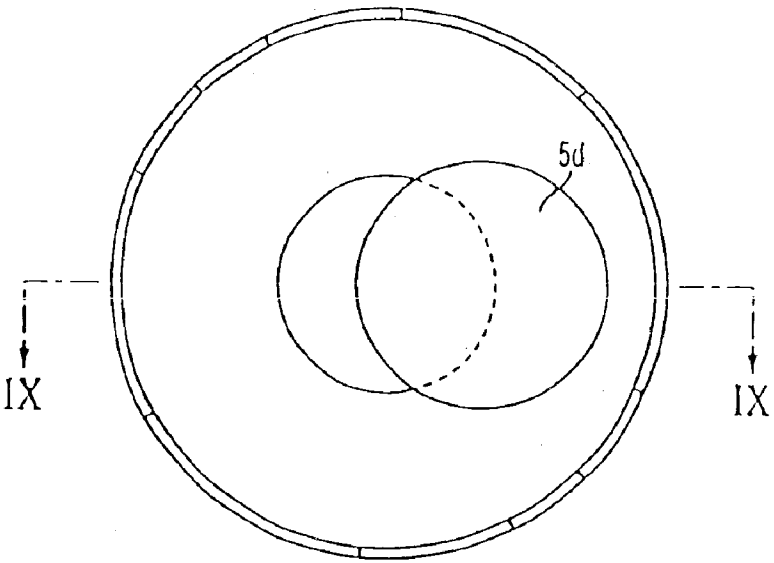
FIGS. 6–9 show a moveable body made of a disc which is designed to move in a hole in the fixed body.
Figure 9:
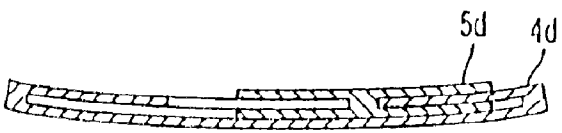
Figure 6:
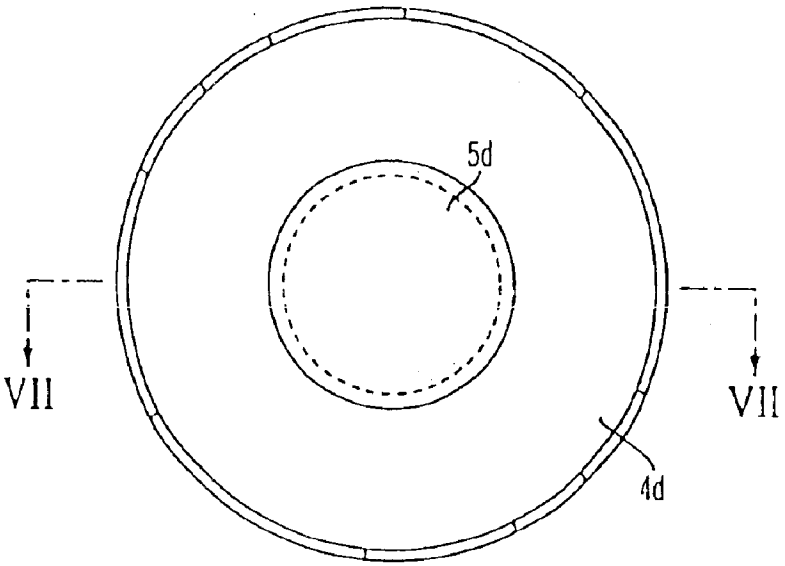
Figure 7:
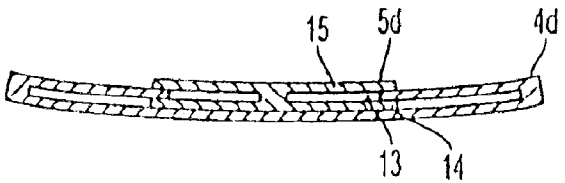

An embodiment is shown in FIG. 4 where the moveable body consists of a ball 5*c* and the fixed body of a box 4*c*. The box 4*c* is equipped with an inclined plane 10 which is preferably curved in such a way that it inclines from the edges of the box and down towards a bottom point 11 at the back edge 12 of the box. In the neutral position, the ball 5*c* will be at the lowest point 11 of the inclined plane. When the head is tipped too far forward or perhaps to the side, the inclined plane will move past the horizontal position and the lowest point 11 will thereby come to be higher than the inclined plane at the opposite end thereof. The ball will thus roll down the inclined plane and strike against the box wall, preferably making an audible sound in doing so. The box 4*c* is preferably closed so that the ball 5*c* is prevented from falling out. The box 4*c* is attached in an appropriate manner to a headband or the like.

FIGS. 6–9 show a fourth embodiment where the moveable body consists of a disc 5*d* and the fixed body consists similarly of a disc 4*d* of greater diameter. As can best be seen in FIG. 7, the disc 4*d* is double and in one wall has a hole 13 of a smaller diameter than the diameter of the disc 5*d*. Said disc 5*d* is also double, but the walls in this case are only connected in the center of the disc. The disc 5*d* is placed in the hole 13 so that one of the walls 14 of the disc 5*d* is on the inside of the edge of the hole, whilst the other wall 15 is on the outside. When the position of the head is correct, the disc 5*d* is centered in the hole 13. On deviation from the correct head position, the disc 5*d* will shift relative to the hole 13 and clearly indicate that the head position is incorrect. Also in this case, an audible sound will preferably be made when the disc 5*d* reaches its outermost position. Both the disc 5*d* and the disc 4*d* are preferably double curved, so that the device is less sensitive to movement. The curve can be varied according to the desired degree of sensitivity.

Figure 10A:
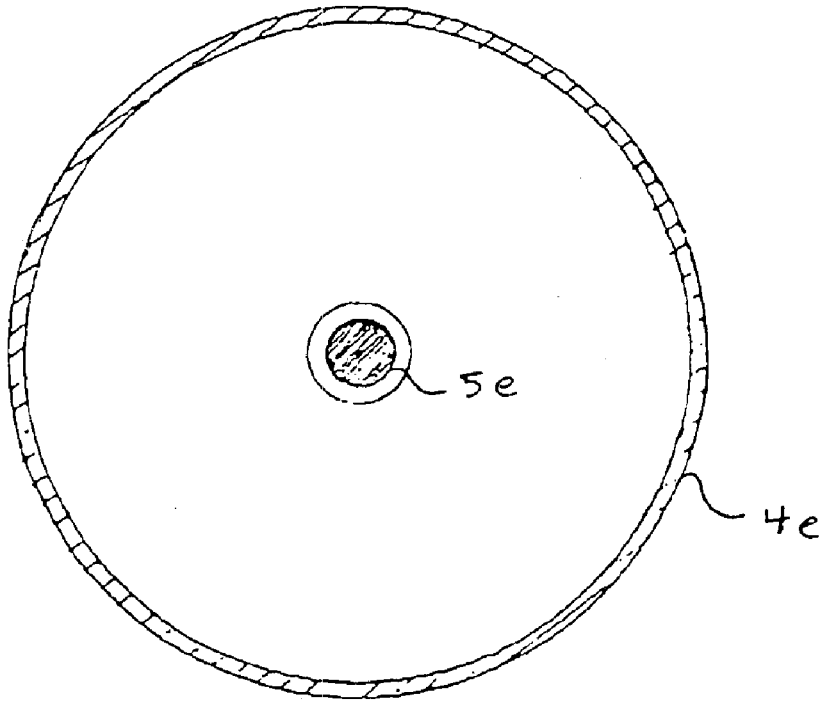
FIGS. 10*a* and 10*b* show a preferred embodiment of the device seen in section from above and from the side, respectively.
Figure 10B:
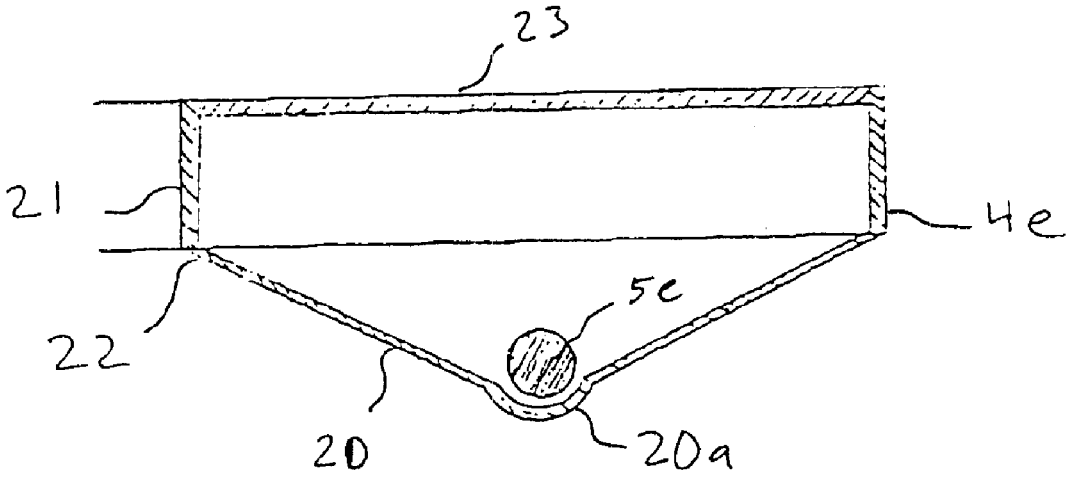

In FIGS. 10*a* and 10*b* is shown a preferred embodiment in which the box 4*e* is fully circular in cross section. The bottom 20 of the box 4*e* is wedge shaped (or conically shaped) with a lowest point approximately in the center of the box and a circular rim 22 forming the highest point. The lowest point may be situated at an indentation 20*a* in the bottom 20. The rim 22 joins a circular side wall 21 of the box. The top of the box is closed by a top wall 23, which may have any desired shape, e.g. flat, as shown.

The box 4*e* may be filled with a fluid with a higher viscosity than air. The fluid may be a liquid. The liquid may be water, alcohol, oil or any other suitable liquid. The purpose of this high viscosity fluid is to slow down the movement of the ball 5*e* and preventing it from swirling around. Due to the high viscosity of the fluid, the box 4*e* will have to be tilted somewhat more before the ball 5*e* starts to roll from the lowest point at the bottom and along the bottom, than what would be the case if the box 4*e* was filled with air. Consequently, this embodiment allows a little bit more flexibility in defining the correct head position.

The viscosity of the fluid is decisive for the amount of flexibility that is given to the apparatus in defining the correct head position. If, e.g., oil is used, the area defining the correct head position will be larger than if, e.g., water is used.

Figure 11A:
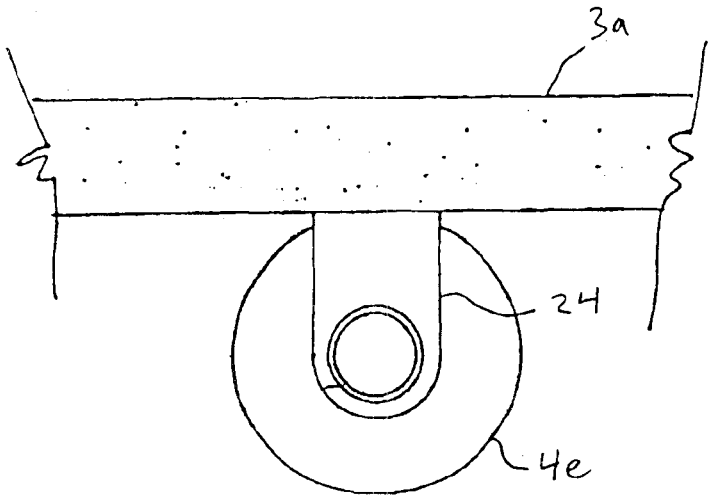
FIGS. 11*a* and 11*b* show the device fastened to the attachment means with a hinged bracket seen from above and from the side, respectively.
Figure 11B:
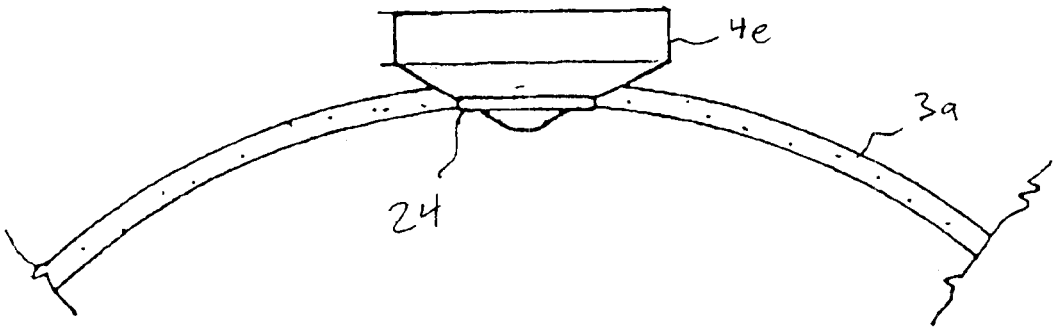
Figure 12:
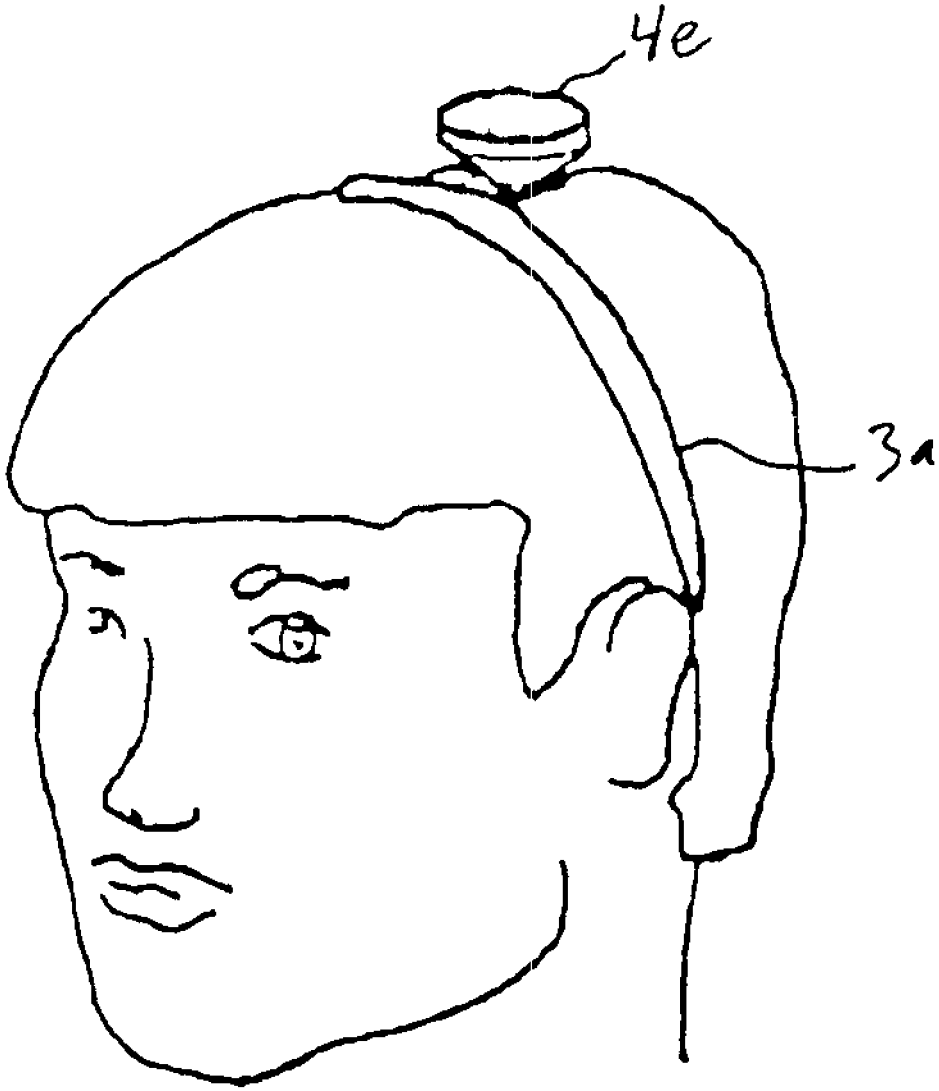
FIG. 12 shows the device in FIGS. 10*a* and 10*b* attached to the user's head.

In FIGS. 11*a* and 11*b* is shown how the box may be fixed to the head bracket. The box is shown attached to an arm 24, which is shaped as a flat piece. The attachment between the box and the arm 24 may be fixed or detachable, e.g., by a threaded connection.

The arm 24 is preferably hingedly connected to a bracket 3*a* of the attachment means. The hinge may be a so-called film hinge formed by a thin flexible piece of material. The arm 24 is conveniently situated on the underside of the bracket 3*a*. When the bracket 3*a* is placed on the person's head, the arm 24 will be pressed against the bracket 3*a*. The arm 24 may also be placed on the upper side of the bracket 3*a* and lie against the bracket 3*a* by gravity. A snap connection between the arm 24 and the bracket 3*a* to hold the parts together is also conceivable. It is also conceivable that the connection between the arm 24 and the bracket 3*a* consist of a hook and loop fastener mechanism (such as Velcro®).

The hinge connection facilitates the packaging and transportation of the apparatus, since this can be laid flat inside a box or the like.

In an embodiment that is not illustrated, the moveable body may consist of a mercury ball or similar which on deviation from the correct head position moves in such a way that it closes an electronic circuit. The electronic circuit may be formed so that it emits an audible sound, e.g., a piping sound, actuates a vibration device, gives a light signal or in another manner indicates that an incorrect head position has been assumed.

The device may also be equipped with a proximity sensor which detects the position of the moveable body and gives a continuous or stepwise signal dependent on the position.

I claim:

1. An indicator device for indicating correct and incorrect head positions of a person's head, comprising:

a base which fits onto the person's head, the base having a shape which adapts to a contour of the person's head;

a housing attached to the base, the housing comprising a top wall, a sloped bottom wall and a side wall, at least a portion of the bottom wall being generally conically shaped, and comprising a first end and a second end, the first end being situated at an indentation formed in the bottom wall and the first end being at a lower position than the second end, the second end being at the perimeter of the bottom wall, the first end being situated at a distance from the perimeter;

an indicator body enclosed and retained in the housing, the indicator body being moveable in a plurality of directions from a start position, the start position of the indicator body corresponding to the correct head position of the person's head, wherein the start position is lower than the perimeter and is located at the first end, and wherein the surface area of the indentation is not more than slightly larger than a portion of surface area of the indicator body that is beneath a top of the indentation as measured when the indicator body is touching a bottom of the indentation;

the housing being at least partially filled with and retaining a fluid with a higher viscosity than air; and wherein when the person's head is deviated from the correct head position to the incorrect head position, the indicator body is deviated in a direction corresponding to a direction from the correct head position to the incorrect head position of the person's head, and the indicator body moves from the start position to one of the plurality of directions and strikes the side wall of the housing causing an audible signal to indicate the incorrect head position.

2. An indicator device according to claim 1, wherein the bottom wall is generally circular, and the first end is situated equidistant from the perimeter of the bottom wall.

3. An indicator device according to claim 1, wherein the first end is situated at an indentation in the bottom wall.

4. An indicator device according to claim 1, wherein the housing is filled with a fluid with a higher viscosity than air.

5. An indicator device according to claim 1, wherein the fluid is a liquid.

6. An indicator device according to claim 5, wherein the fluid comprises a fluid including at least one of: water or alcohol.

7. An indicator device according to claim 5, wherein the fluid comprises oil.

8. An indicator device according to claim 1 wherein the surface area of the indentation as compared to the portion of the surface area of the indicator body substantially prevents the indicator body from substantially moving within the indentation as a result of slight deviations from the correct head position.

9. An indicator device for indicating correct and incorrect head positions of a person's head, comprising:

a base which fits onto the person's head, the base having a shape which adapts to a contour of the person's head;

a housing attached to the base, the housing comprising a top wall, a sloped bottom wall and a side wall, the bottom wall being generally wedge shaped, and comprising a first end and a second end, the first end being situated at an indentation formed in the bottom wall and the first end being at a lower position than the second end, the second end being at the perimeter of the bottom wall, the first end being situated at a distance from the perimeter;

an indicator body enclosed and retained in the housing, the indicator body being moveable in a plurality of directions from a start position, the start position of the indicator body corresponding to the correct head position of the person's head, wherein the start position is lower than the perimeter and is located at the first end, and wherein the surface area of the indentation is not more than slightly larger than a portion of surface area of the indicator body that is beneath a top of the indentation as measured when the indicator body is touching a bottom of the indentation; and wherein when the person's head is deviated from the correct head position to the incorrect head position, the indicator body is deviated in a direction corresponding to a direction from the correct head position to the incorrect head position of the person's head, and the indicator body moves from the start position to one of the plurality of directions and strikes the side wall of the housing causing an audible signal to indicate the incorrect head position;

said housing being at least partially filled with and retaining a fluid with a viscosity greater than air.

10. An indicator device for indicating correct and incorrect head positions of a person's head, comprising:

a base which fits onto the person's head, the base having a variable shape which can change based on a contour of the person's head;

a housing attached to the base, the housing comprising a top wall, a sloped bottom wall and a side wall, the bottom wall comprising a first end and a second end, the first end being situated at an indentation formed in the bottom wall and the first end being at a lower position than the second end, the second end being at a perimeter of the bottom wall, the first end being situated at a distance from the perimeter;

an indicator body enclosed and retained in the housing, the indicator body being moveable in a plurality of directions from a start position, the start position of the indicator body corresponding to the correct head position of the person's head, wherein the start position is lower than the perimeter and is located at the first end, and wherein the surface area of the indentation is not more than slightly larger than a portion of surface area of the indicator body that is beneath a top of the indentation as measured when the indicator body is touching a bottom of the indentation; and wherein when the person's head is deviated from the correct head position to the incorrect head position, the indicator is deviated in a direction corresponding to a direction from the correct head position to the incorrect head position of the person's head, and the indicator body moves from the start position to one of the plurality of directions and strikes the side wall of the housing causing an audible signal to indicate the incorrect head position.

11. An indicator device for indicating correct and incorrect head positions of a person's head, comprising:

a base which fits onto the person's head, the base having a variable shape which can change based on a contour of the person's head;

a housing attached to the base, the housing comprising a top wall, a sloped bottom wall and a side wall, the bottom wall comprising a first end and a second end, the first end being situated at an indentation formed in the bottom wall and the first end being at a lower position than the second end, the second end being at a perimeter of the bottom wall, the first end being situated at a distance from the perimeter;

an indicator body enclosed and retained in the housing, the indicator body being moveable in a plurality of directions from a start position, the start position of the indicator body corresponding to the correct head position of the person's head, wherein the start position is lower than the perimeter and is located at the first end, and wherein the indentation is configured to hold the indicator body so that the indicator body is substantially prevented from leaving the indentation as a result of a slight deviation from the correct head position; and wherein when the person's head is deviated from the correct head position to the incorrect head position, the indicator is deviated in a direction corresponding to a direction from the correct head position to the incorrect head position of the person's head, and the indicator body moves from the start position to one of the plurality of directions and strikes the side wall of the housing causing an audible signal to indicate the incorrect head position.

* * * * *